US011186434B2

(12) United States Patent
Chua

(10) Patent No.: US 11,186,434 B2
(45) Date of Patent: Nov. 30, 2021

(54) CONVERTIBLE BAG WITH PACKAGING MAILER AND DRAWSTRING BAG CONFIGURATIONS, AND COMPONENTS AND METHODS OF USE THEREOF

(71) Applicant: Song Ru Chua, Singapore (SG)

(72) Inventor: Song Ru Chua, Singapore (SG)

( * ) Notice: Subject to any disclaimer, the term of this patent is extended or adjusted under 35 U.S.C. 154(b) by 214 days.

(21) Appl. No.: 16/666,910

(22) Filed: Oct. 29, 2019

(65) Prior Publication Data

US 2021/0122566 A1 Apr. 29, 2021

(51) Int. Cl.
*B65F 1/00* (2006.01)
*B65D 27/14* (2006.01)
*B65D 27/34* (2006.01)

(52) U.S. Cl.
CPC ..... *B65F 1/002* (2013.01); *B65D 27/14* (2013.01); *B65D 27/34* (2013.01)

(58) Field of Classification Search
CPC ..... B65F 1/002; B65D 27/14; B65D 17/34; B65D 33/18; B65D 33/28
USPC ..... 383/61.4, 203–204, 75, 84, 62, 4
See application file for complete search history.

(56) References Cited

U.S. PATENT DOCUMENTS 3,119,549 A * 1/1964 Schoen ..... B65D 33/28 383/204
3,982,687 A * 9/1976 Auer ..... B65D 33/28 383/204
7,581,886 B2 9/2009 Nitti
8,448,828 B2 5/2013 Nitti
2011/0155794 A1 6/2011 Russell
2012/0189228 A1 6/2012 Grossman
2019/0135495 A1 5/2019 Greenwood
2020/0071072 A1* 3/2020 Eberhard ..... B65F 1/002
2021/0163183 A1* 6/2021 Reilly ..... B65D 81/3897

FOREIGN PATENT DOCUMENTS

DE 2618677 A1 * 11/1976 ..... B65D 33/10
FR 2299962 A1 * 9/1976 ..... B65D 33/28
GB 825257 A * 12/1959 ..... B65D 33/28
WO WO-2019068705 A1 * 4/2019 ..... B65D 27/14

* cited by examiner

*Primary Examiner* — Jes F Pascua
(74) *Attorney, Agent, or Firm* — Mei & Mark LLP

(57) ABSTRACT

A convertible bag is provided. It may include a bag front, a bag back, a drawstring retention compartment, and at least one drawstring. The bag front may include a front perforation, a front part of the drawstring retention compartment, and a mailer front top with a top flap. The bag back may include a mailer back top, a back perforation, and a back part of the drawstring retention compartment. The convertible bag may be configured for converted from a packaging mailer configuration to a drawstring bag configuration. In the packaging mailer configuration, the top flap of the mailer front top may be folded over and secured to the mailer back top to close the convertible bag. In the drawstring bag configuration, the convertible bag may be configured to be cinched closed by pulling a portion of the at least one drawstring out of the drawstring retention compartment.

19 Claims, 10 Drawing Sheets

CONVERTIBLE BAG WITH PACKAGING MAILER AND DRAWSTRING BAG CONFIGURATIONS, AND COMPONENTS AND METHODS OF USE THEREOF

TECHNICAL FIELD

The present disclosure relates to the field of packaging for shipping, and more particularly to a convertible bag that may be used as a packaging mailer and subsequently as a drawstring bag, such as a trash bag.

BACKGROUND

To accommodate the popularity of Internet-based shopping, among other things, a large volume of packaging for product shipping to consumers and businesses is being manufactured and used. Such packaging may include boxes, bags, envelopes and/or other types of packaging mailers; it may comprise various types of plastics, cardboard, padding, and the like. Typically, such packaging is disposed of after a single use: that is, a typical consumer will throw away used packaging mailers or the like upon receipt and removal of their contents.

Accordingly, there is a need to reduce the negative environmental impact associated with packaging for product shipping, such as by reducing the single use of plastics.

It may be desirable for packaging mailers to be configured for repurposing and/or reuse after completion of their initial shipping function. For example, a packaging mailer that could be configured to be converted into a bag to be re-used as a trash bag, a recycling bag, and/or another type of bag may be desirable.

It may also be desirable for packaging mailers, the like, and/or components thereof to be comprised of biodegradable or/and compostable materials.

SUMMARY

The present disclosure provides a description of apparatuses, components thereof, and methods of uses thereof to address the perceived needs described above, as well as to improve technologies relating to disposable packaging mailers.

In one embodiment, a convertible bag is provided. The convertible bag may include a bag front, a bag back, a bag bottom, a first side, a second side, a drawstring retention compartment, and at least one drawstring. The bag front may include a front perforation, a front part of the drawstring retention compartment, and a mailer front top with a top flap. The bag back may include a mailer back top, a back perforation, and a back part of the drawstring retention compartment. The at least one drawstring may be disposed within the retention compartment. The bag bottom, the first side, and the second side edge may connect the bag front and the bag back. The convertible bag may be configured to be converted from a packaging mailer configuration to a drawstring bag configuration. In the packaging mailer configuration, the top flap of the mailer front top may be folded over and secured to the mailer back top to close the convertible bag. The front perforation may be disposed between the mailer front top and the front part of the drawstring retention compartment. The back perforation may be disposed between the mailer back top and the back part of the drawstring retention compartment. The front perforation and the back perforation may be configured to be simultaneously torn by hand. In the drawstring bag configuration, the convertible bag may be configured to be cinched closed by pulling a portion of the at least one drawstring out of the drawstring retention compartment.

In some embodiments, the at least one drawstring may not be secured to any element of the convertible bag that is outside of the drawstring retention compartment.

The convertible bag may further include a first drawstring access opening. The first drawstring access opening may be disposed along the front part of the drawstring retention compartment. The convertible bag may further include a second drawstring access opening. The second drawstring access opening may be disposed along the back part of the drawstring retention compartment.

The first drawstring access opening may include a gap in an outer layer of the front part of the drawstring retention compartment.

The first drawstring access opening may include a gap on an inner layer of the front part of the drawstring retention compartment.

In the packaging mailer configuration, the first drawstring access opening may be covered by a first drawstring access panel. The front part of the drawstring retention compartment may include the first drawstring access panel. The connection between the first drawstring access panel and at least one component of a remainder of the front part of the drawstring retention compartment may be perforated.

The convertible bag may further include a first drawstring anchor. The first drawstring anchor may be configured to prevent the at least one drawstring from rotating within the drawstring retention compartment. The first drawstring anchor may include a seam along the first side. The convertible bag may further include a second drawstring anchor. The second drawstring anchor may include a seam along the second side.

The convertible bag may further include a first drawstring access opening. The first drawstring access opening may be disposed along the drawstring retention compartment at the first side. The convertible bag may further include a second drawstring access opening. The second drawstring access opening may be disposed along the drawstring retention compartment at the second side.

The front part of the drawstring retention compartment may be bounded by a front top seam and a front bottom seam. The front top seam may be at least partially co-extensive with the front perforation.

The back part of the drawstring retention compartment may be bounded by a back top seam and a back bottom seam. The back top seam may be at least partially co-extensive with the back perforation.

In the packaging mailer configuration, the drawstring may be entirely contained within the drawstring retention compartment.

In another embodiment, a method of using a convertible bag is provided. The method may include receiving a convertible bag as a packaging mailer, tearing a front perforation and a back perforation of the convertible bag to remove a top portion of the convertible bag, removing first contents from the convertible bag, placing second contents in the convertible bag, pulling a portion of a drawstring of the convertible bag out of a drawstring retention compartment of the convertible bag, and cinching the convertible bag closed with the drawstring.

The method may further include, after removing first contents from the convertible bag, installing the convertible bag in a trash can. The step of placing second contents in the bag may include placing refuse in the convertible bag. The method may further include, after cinching the top of the convertible bag closed with the drawstring, making a knot with the drawstring to secure the refuse in the convertible bag.

The method may further include, before pulling the portion of the drawstring of the convertible bag out of the drawstring retention compartment of the convertible bag, removing a drawstring access cover.

It is to be understood that the descriptions herein are exemplary and explanatory only, and are not restrictive of the invention.

BRIEF DESCRIPTION OF THE DRAWINGS

The accompanying drawings, which are incorporated into and constitute a part of this specification, illustrate several embodiments and aspects of the methods, apparatuses, and apparatus components described herein and, together with the description, serve to explain the principles of the invention.

DETAILED DESCRIPTION

FIGS. 1A-2H depict elements and various stages of use of convertible bag 100. Convertible bag 100 may be convertible from packaging mailer configuration 100A to drawstring bag configuration 100B. In packaging mailer configuration 100A, convertible bag 100 may initially be used for shipping, mailing, and/or other courier services. As may be observed in, for example, FIGS. 1A, 2C, and 2D, convertible bag 100 may substantially resemble typical shipping mailers when used for this initial purpose. In drawstring bag configuration 100B, convertible bag 100 may be re-used as a drawstring bag. As may be observed in, for example, FIGS. 2G and 2H, convertible bag 100 may be re-used as a trash bag, a recycling bag, or a bag for carrying other items.

Figure 1A:
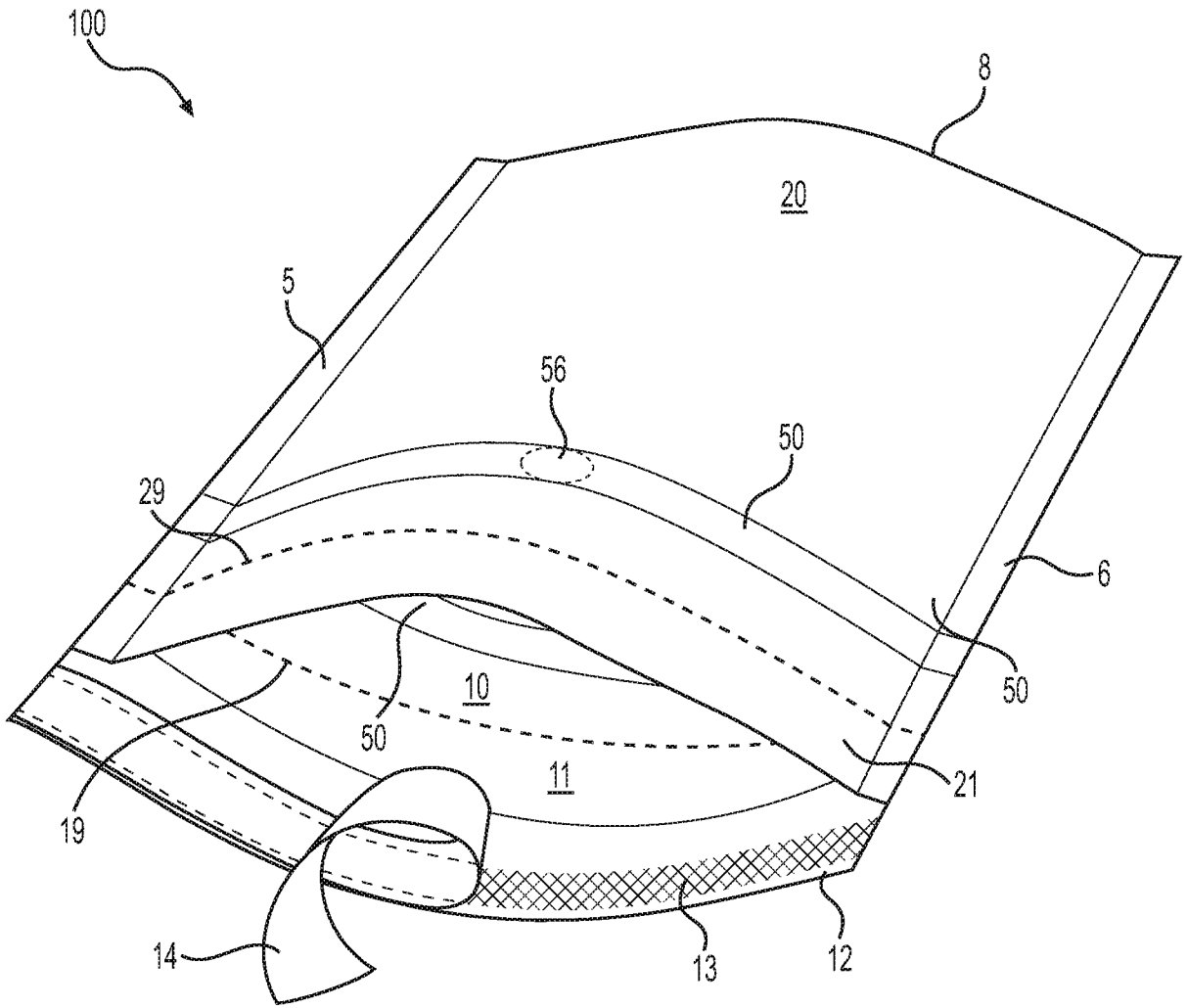
FIGS. 1A and 1B are back perspective views of a convertible bag, in accordance with exemplary embodiments.
Figure 1B:
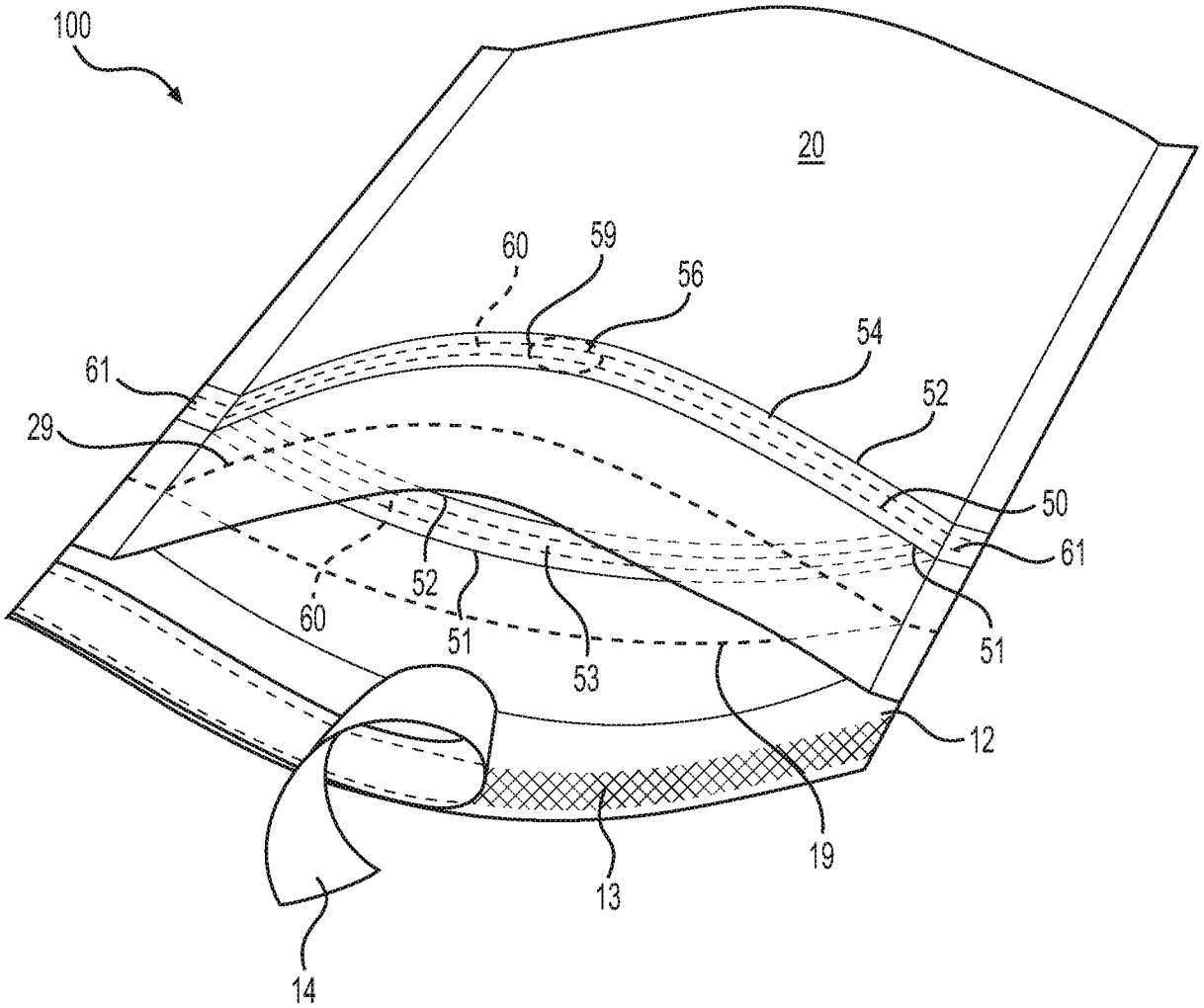

With reference to, for example, FIGS. 1A and 1B, an embodiment of convertible bag 100 is shown from a back perspective view. Convertible bag 100 may include bag front 10, bag back 20, bag bottom 8, first side 5, and second side 6. Bag front 10 and bag back 20 may be connected together at bag bottom 8, first side 5, and second side 6. Accordingly, prior to use, convertible bag 100 may form an enclosure with an opening at the top. Bag bottom 8, first side 5, and/or second side 6 may comprise folds and/or seals of the same sheet(s) of material as bag front 10 and/or bag back 20. It is contemplated that convertible bag 100 substantially comprise plastic material, but this disclosure is not so limited. In certain embodiments, convertible bag 100 may entirely or substantially comprise biodegradable or/and compostable plastics or other materials.

Bag back 20 may include mailer back top 21 and back perforation 29. Mailer back top 21 may be disposed opposite from bag bottom 8. Back perforation 19 may demarcate mailer back top 21 from the remainder of bag back 20. Back perforation 29 may comprise a tearable perforation or the like.

Bag front 10 may include mailer front top 11 and front perforation 19. Obscured portions of front perforation 19 are shown in FIG. 1B. Mailer front top 11 may be disposed opposite from bag bottom 8. Front perforation 19 may demarcate mailer front top 11 from the remainder of bag front 10. Front perforation 19 may comprise a tearable perforation or the like. Back perforation 29 and front perforation 19 may preferable be aligned to facilitate their tearing simultaneously.

Mailer front top 11 may further include flap 12 opposite from bag bottom 8. Flap 12 may include an adhesive strip 13 or the like, which may serve to affix flap 12 to mailer back top 21 in packaging mailer configuration 100A. Convertible bag 100 may further include adhesive strip cover 14 to prevent adhesive strip 13 from fastening to an inappropriate surface or fastening at an appropriate time.

Convertible bag 100 may also include drawstring retention compartment 50 and drawstring 60, which may house drawstring 60. Drawstring retention compartment 50 may have a front part disposed on bag front 10 and a back part disposed on bag back 20. Each of the front and back parts of drawstring retention compartment 50 may two layers: inner layer 53 facing the inside of convertible bag 100, and outer layer 54 facing the inside of convertible bag 100. At least one layer may be integrally formed with a sheet comprising bag front 10 and/or bag back 20. Drawstring retention compartment 50 may be bounded at the bottom by lower seam 52 and at the top by upper seam 51. Obscured portions of drawstring retention component 50 are shown in FIG. 1B. In certain embodiments, drawstring retention compartment width 50' may be between 15 mm and 40 mm, or more preferably between 25 mm and 30 mm.

Figure 1C:
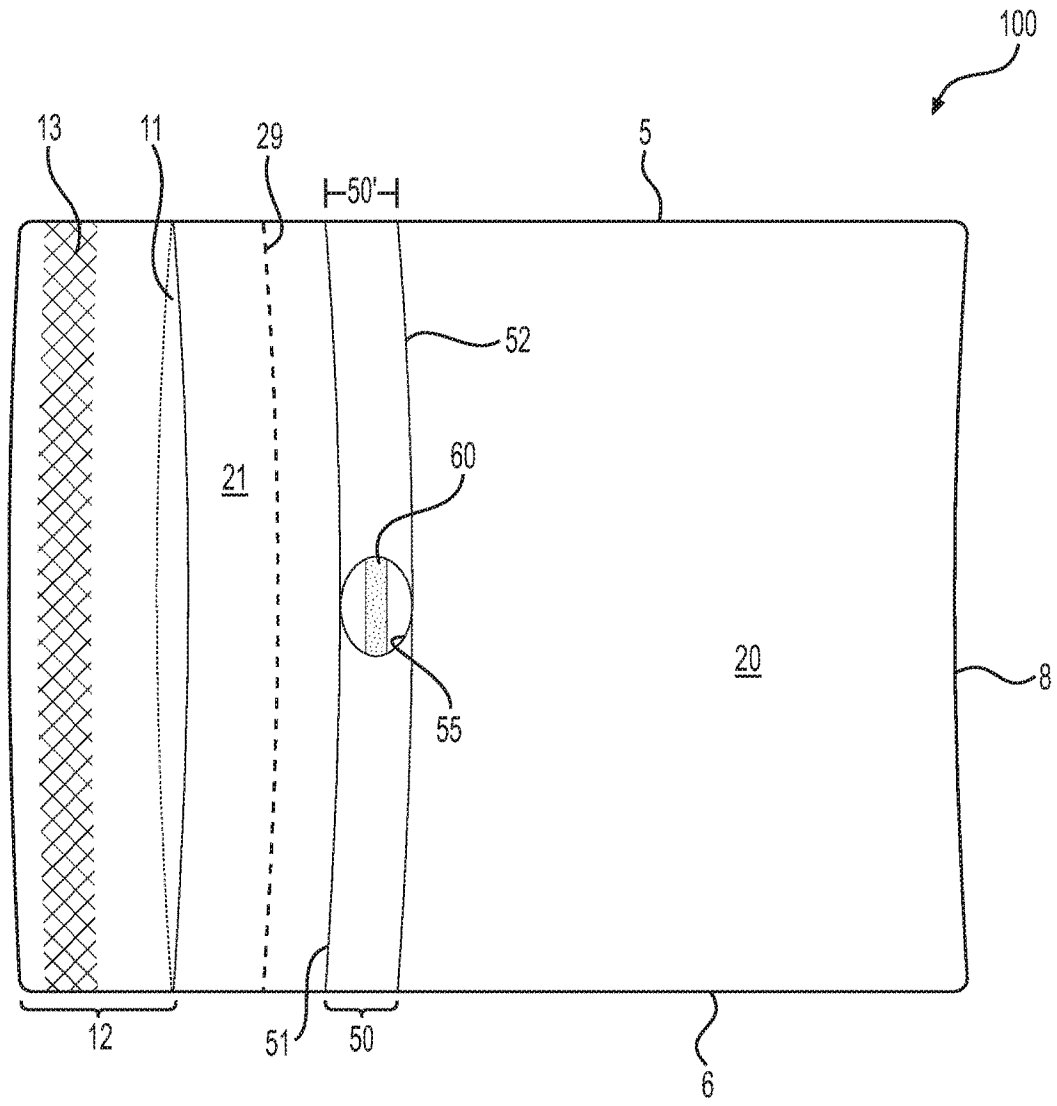
FIGS. 1C and 1D are back views of convertible bags, in accordance with exemplary embodiments.
Figure 1D:
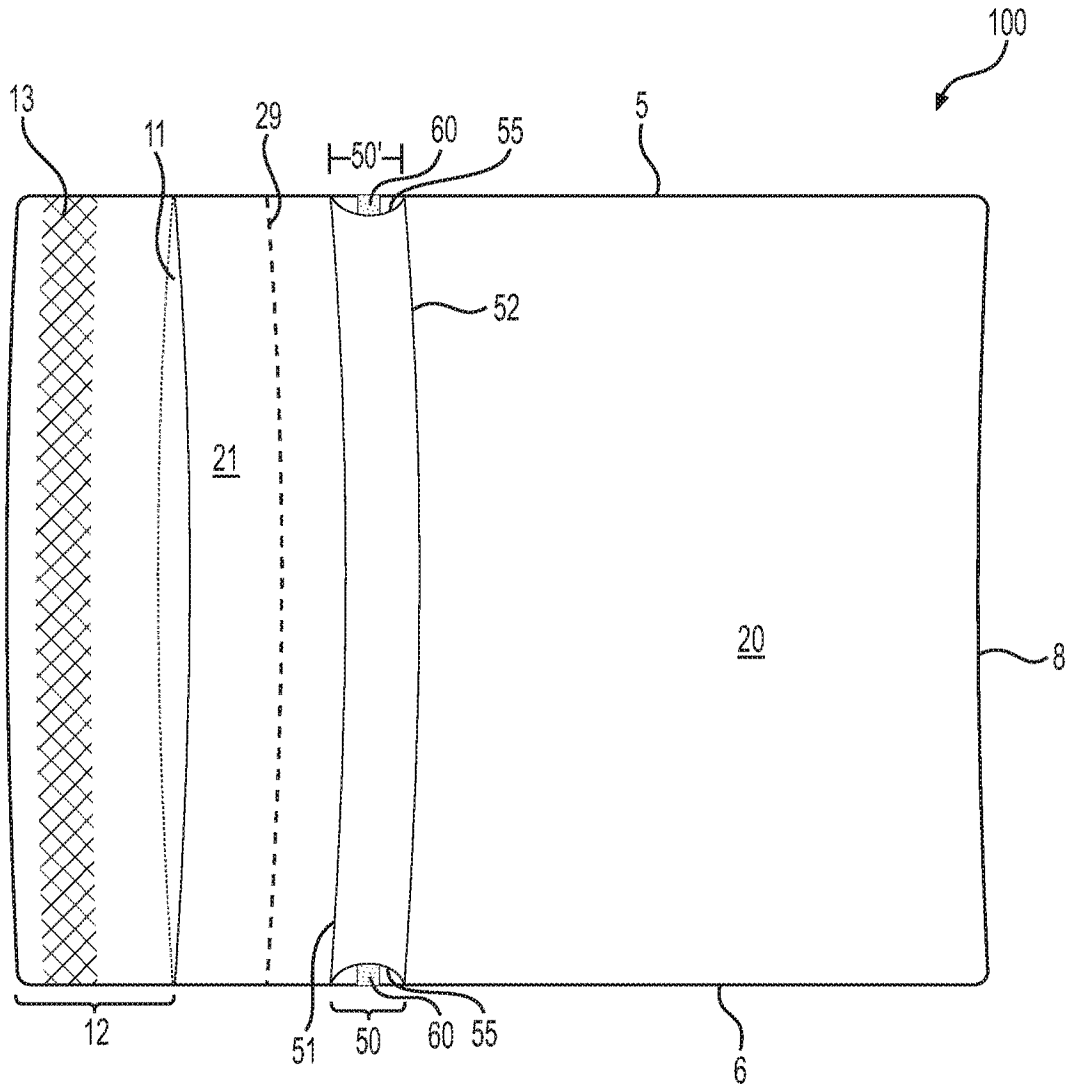
Figure 2B:
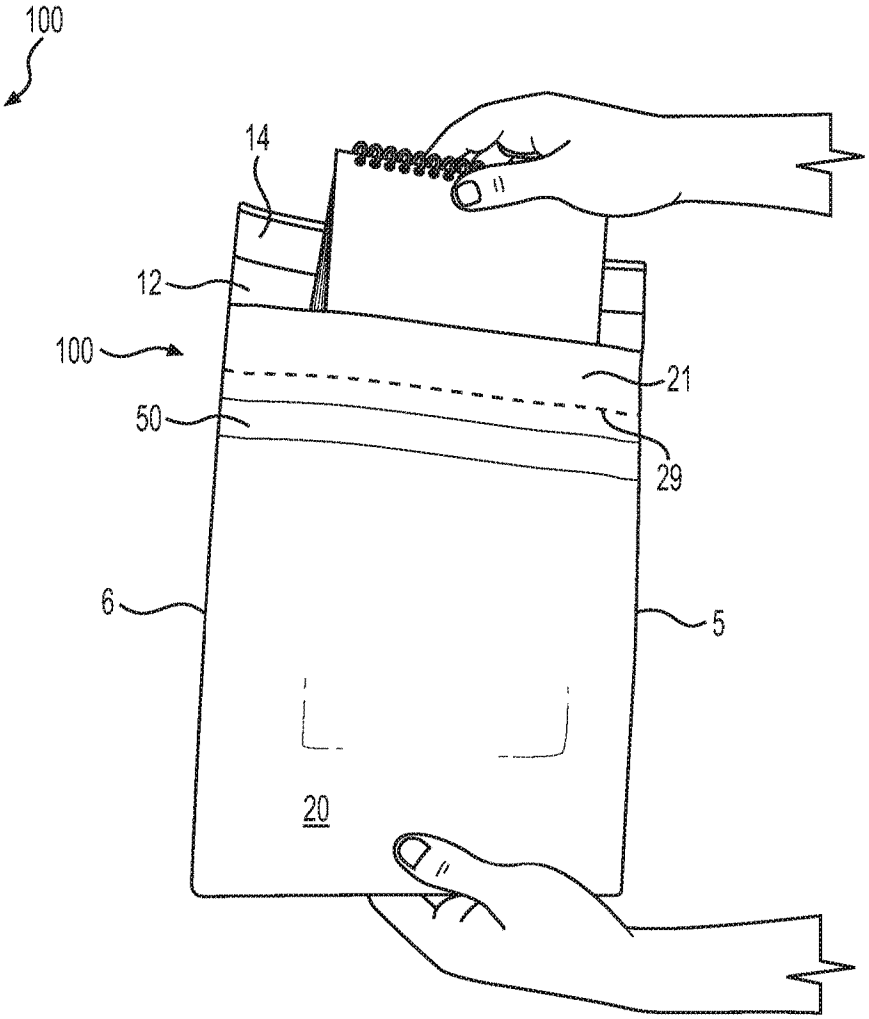
FIGS. 2A-2H are illustrations of a convertible bag in various configurations and stages of use, in accordance with exemplary embodiments.
Figure 2A:
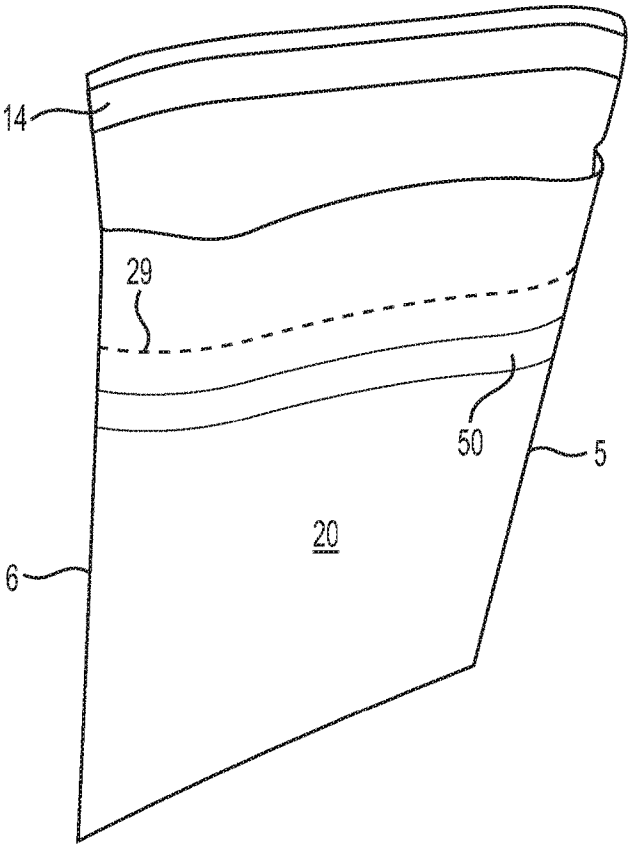
Figure 2D:
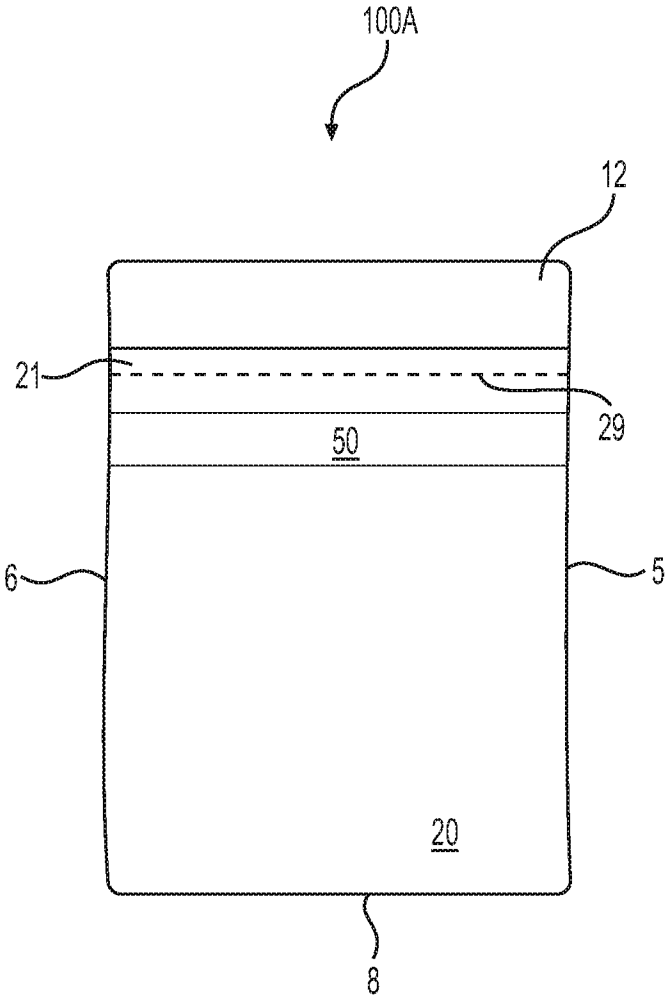
Figure 2C:
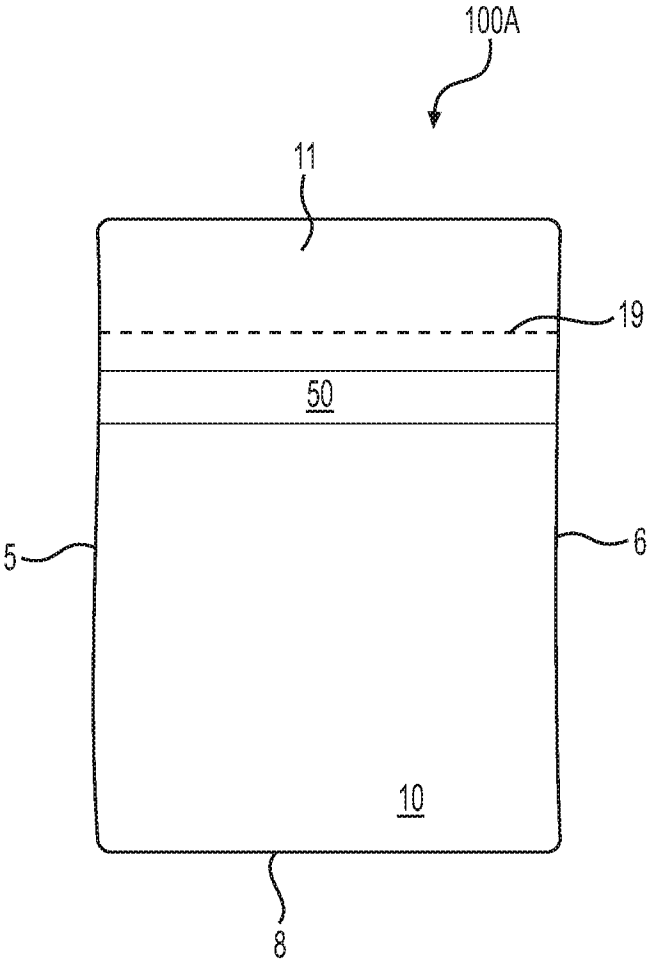
Figure 2F:
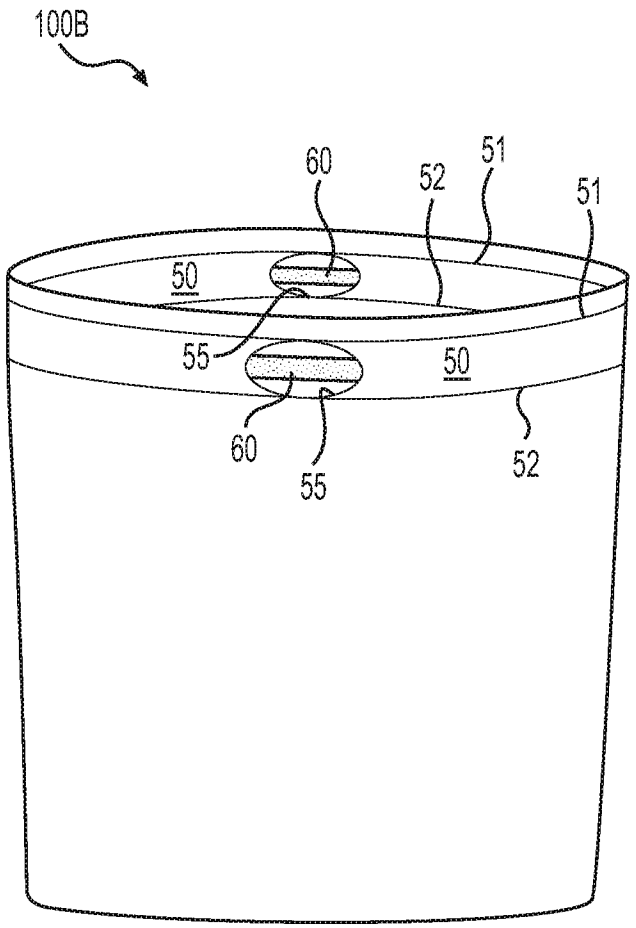

With reference to, for example, FIGS. 1C and 1D, drawstring retention compartment 50 may comprise one or more drawstring access openings 55 through which drawstring 60 may be pulled through in drawstring bag configuration 100B. Drawstring access opening(s) 55 may be disposed on inner layer 53 and/or outer layer 54 of drawstring retention compartment 50. An embodiment with drawstring access openings 55 on each of inner layer 53 and outer layer 54 is depicted in FIG. 2F. In other embodiments, all drawstring access openings 55 may be disposed on either inner layer 53 or outer layer 54. In some embodiments, for example as shown in FIG. 1C, drawstring access opening(s) 55 may be located on the (internal and/or external) faces of bag front 10 and/or bag back 20, such as in a central location. In other embodiments, for example as shown in FIG. 1D, drawstring access opening(s) 55 may be located on the first side 5 and/or second side 6 of convertible bag 100; in such embodiments, each drawstring access opening 55 may be partially disposed on bag front 10 and bag back 20.

Figure 2E:
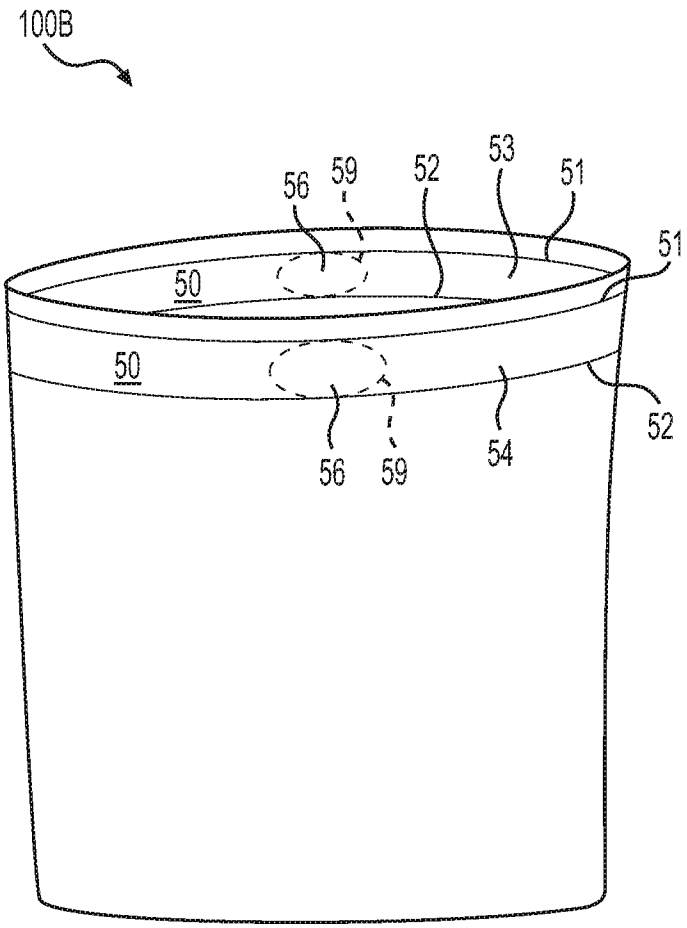

With reference to, for example, FIG. 1B, in some embodiments, drawstring retention compartment 50 may comprise one or more drawstring access covers 56 to prevent premature access to drawstring 60 via drawstring access opening(s) 55. Drawstring access covers 56 may block drawstring access opening 55 until its removal. An embodiment with drawstring access covers 56 on each of inner layer 53 and outer layer 54 is depicted in FIG. 2E. In other embodiments, all drawstring access covers 56 may be disposed on either inner layer 53 or outer layer 54. Drawstring access cover(s) 55 may be attached to a layer of drawstring retention compartment 50 via access cover detachment perforation 59. The inclusion of drawstring access cover(s)

56 may be particularly advantages in embodiments where drawstring access opening(s) 55 may be disposed on outer layer 54; this may serve to further reduce the likelihood of drawstring 60 being caught and/or pulled on during shipping or processing.

Drawstring 60 may be comprised of plastic and/or other materials known to those of skill in the art. With reference to, for example FIG. 1B, drawstring 60 may stabilized within convertible bag 100 at one or more drawstring anchor 61. This may prevent rotation of drawstring 60 within drawstring retention compartment 50. In certain embodiments, a seal along first side 5 and/or second side 6 may comprise drawstring anchor (s) 61.

In some embodiments, multiple drawstrings 60 may be included within drawstring retention compartment 50. For example, multiple drawstrings of different colors may be advantageously included to permit the convertible bag re-user to differentiate different types of refuse for recycling, and/or otherwise designate the contents of convertible bag 100 in a drawstring bag configuration 100B.

Figure 4B:
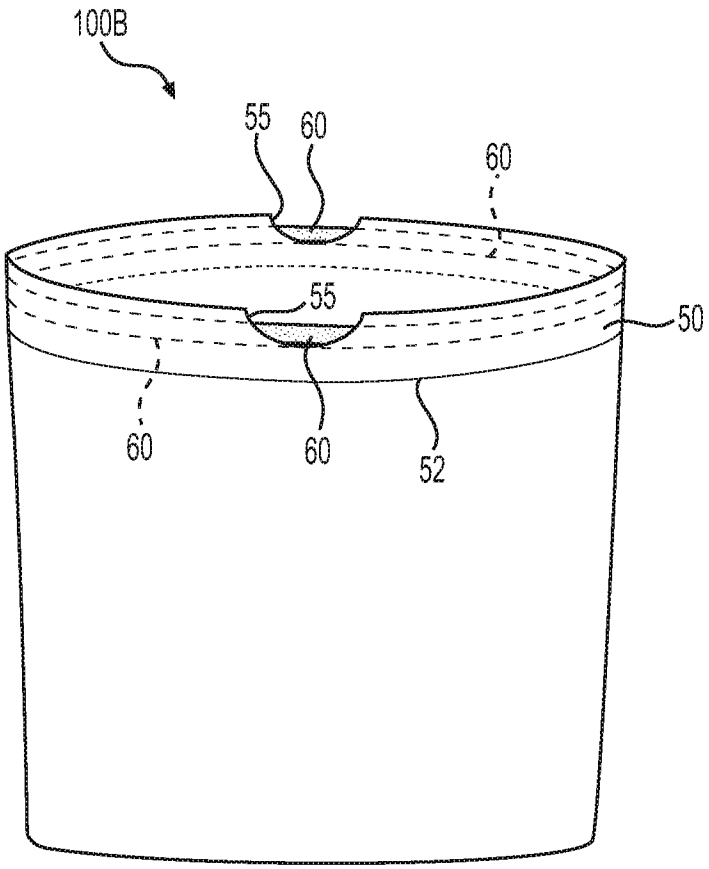
FIGS. 4A and 4B are illustrations of an alternative convertible bag, in accordance with exemplary embodiments.
Figure 4A:
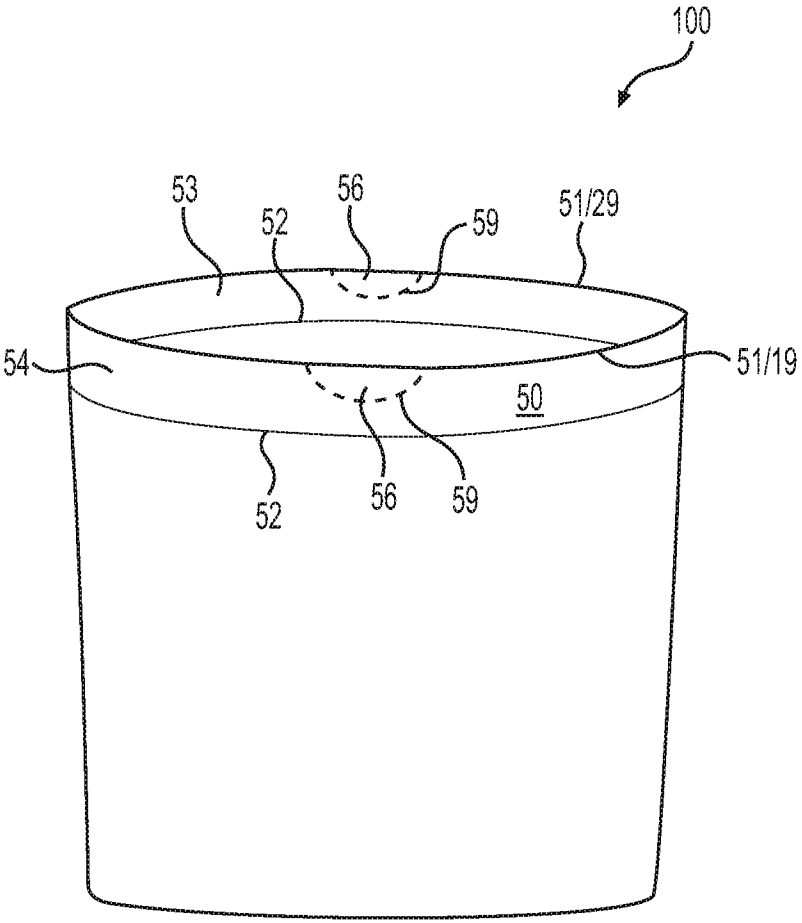

In alternative embodiments, top seam 51 may be co-extensive with front perforation 19 and back perforation 29, collectively. In such embodiments of convertible bag 100, drawstring retention compartment 50 may abut front perforation 19 and back perforation 29. FIG. 4A depicts an example of such embodiment of convertible bag 100 with the top portion of the bag removed. In FIG. 4A, it may be observed that drawstring access covers 56 have not yet been removed. FIG. 4B depicts this embodiment of convertible bag 100 in a drawstring bag configuration 100B, with exposed drawstring access opening(s) 55. The example of FIG. 4B also illustrates that drawstring access opening(s) 55—as well as any corresponding removed drawstring access covers 56—may span both inner layer 53 and outer layer 54 in some requirements.

Additionally, it is contemplated that, in certain alternative embodiments, drawstring access cover(s) 56 may be removed by the mechanical action of tearing front perforation 19 and back perforation 29. Effectively, in such embodiments, drawstring access opening(s) 55 will be automatically exposed when the top of convertible bag 100 in a packaging mailer configuration 100A is removed.

Figure 3:
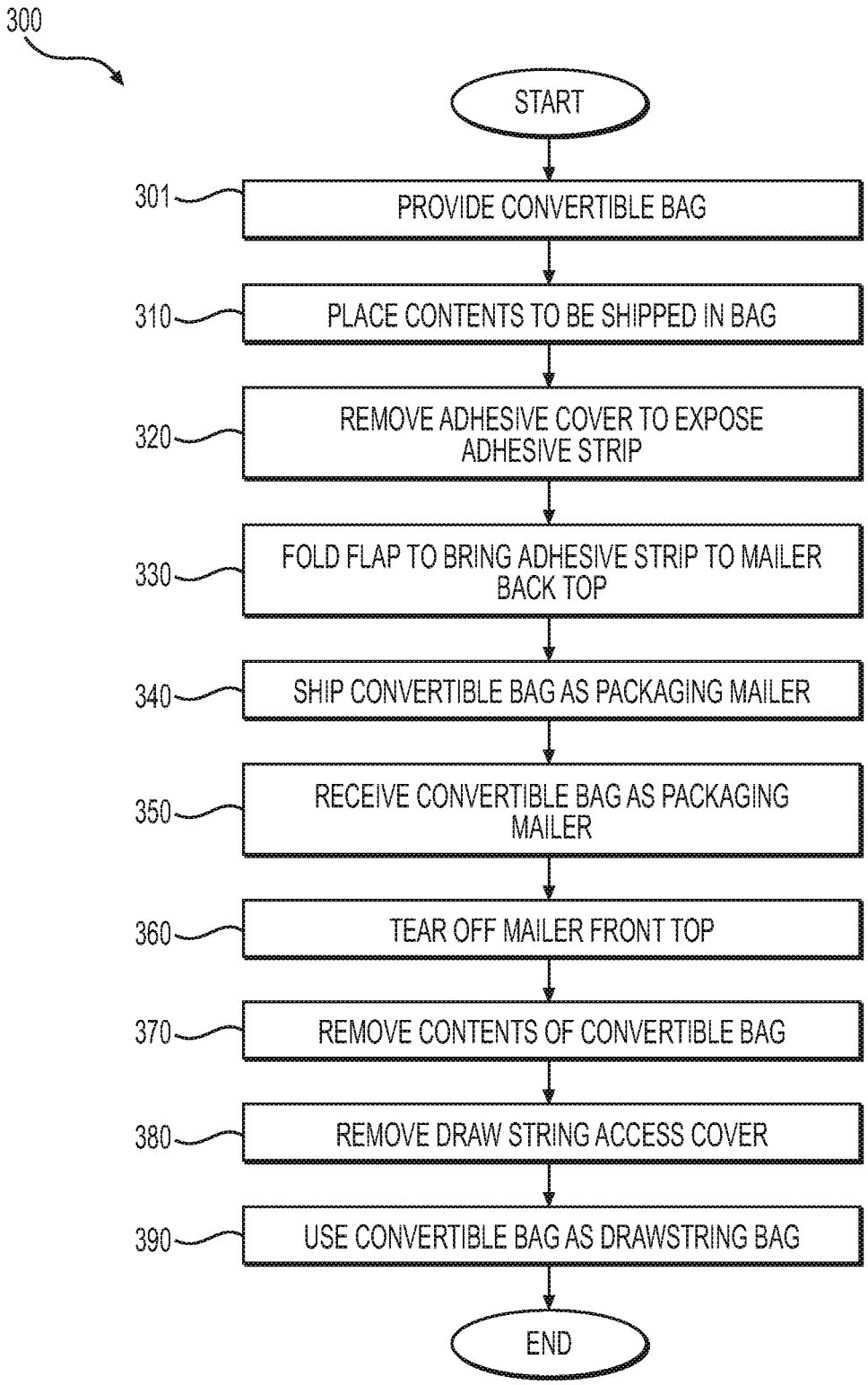
FIG. 3 is a flow chart illustrating use and operation of a convertible bag, in accordance with exemplary embodiments.

With reference to FIG. 3, method 300 for using convertible bag 100 is provided.

As in step 301, convertible bag 100 may be provided. An embodiment of step 301 is depicted in FIG. 2A. The process may proceed to step 310.

As in step 310, a product to be shipped and/or other contents may be placed in convertible bag 100. An embodiment of step 310 is depicted in FIG. 2B. The process may proceed to step 320.

As in step 320, adhesive cover 14 may be removed to expose adhesive strip 13. The process may proceed to step 330.

As in step 330, flap 12 may be folded over to substantially cover mailer back top 21, and adhesive strip 13 may be affixed to seal the contents to be shipped in convertible bag 100. Convertible bag 100 may be considered to be in packaging mailer configuration 100A. FIGS. 2C and 2D are back and front views, respectively, of an embodiment of convertible bag 100 in a packaging mailer configuration 100A. The process may proceed to step 340.

As in step 340, convertible bag 100 and its contents may be shipped and delivered via a courier and/or the like. The process may proceed to step 350.

As in step 350, a recipient may receive the convertible bag 100. The process may proceed to step 360.

As in step 360, a recipient may tear front perforation 19 and back perforation 29, and thereby remove the top portion of remove the top portion of convertible bag 100. This top portion may be discarded. FIG. 2E depicts an embodiment of convertible bag 100 with the top portion removed. The process may proceed to step 370.

As in step 370, the shipped product and/or other contents may be removed by the recipient. The process may proceed to step 380.

As in step 380, a recipient may remove drawstring access cover(s) 56 to uncover drawstring access opening(s) 55. The process may proceed to step 370. In embodiments of convertible bag 100 without drawstring access cover(s) 56, step 380 may be omitted. FIG. 2E depicts an embodiment of convertible bag 100 with the top portion removed and drawstring access cover(s) 56—if any removed. The process may proceed to step 390.

As in step 390, convertible bag 100 may be used in drawstring bag configuration 100B.

Figure 2H:
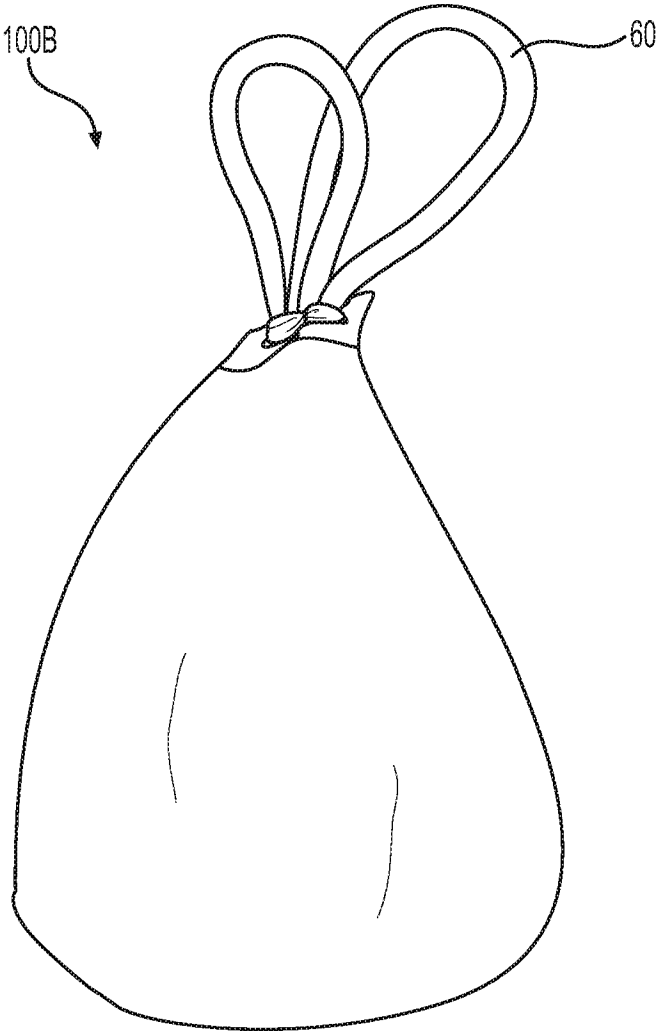
Figure 2G:
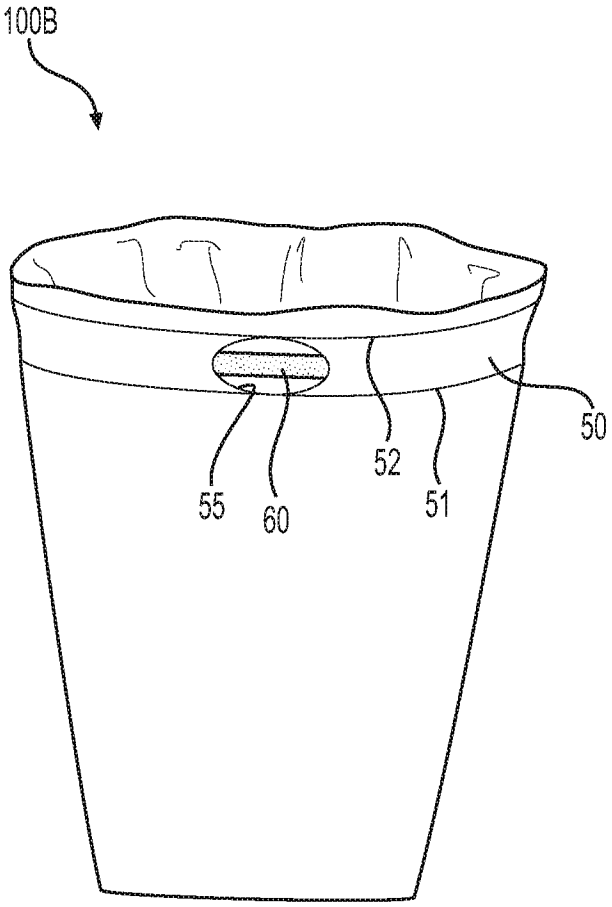

In one example, as shown in FIG. 2G, convertible bag 100 may be installed in a trashcan or recycling bin. As shown, bag bottom 8 may be inserted into a trashcan, and drawstring retention compartment 50 may be folded or otherwise secured on the trashcan rim. Trash, recycling, compostable material, and/or other contents may be placed in convertible bag 100. Convertible bag 100 may be removed from the trashcan. A portion of drawstring 60 may be pulled through drawstring access opening(s) 55. Then the convertible bag 100 in drawstring bag configuration 100B may be cinched closed using drawstring 60. Drawstring 60 may then be knotted to secure the contents of the convertible bag, for example as shown in FIG. 2H. In preferred embodiments, convertible bag 100 in at least the drawstring bag configuration 100B may be substantially waterproof to enhance use as a trash bag. Convertible bag 100 may be disposed of after its re-use as a trash bag—along with its contents.

In another example, convertible bag 100 in drawstring bag configuration 100B may be used as a shopping or utility bag. Items may be placed in the bag for transport or later use. A portion of drawstring 60 may be pulled through drawstring access opening(s) 55 to use as a handle, to cinch the bag closed, and/or to otherwise facilitate carrying, use, storage, and/or placement of convertible bag 100.

In some embodiments, for example, where drawstring access opening(s) 55 are on inner layer 53, it may be preferable to turn convertible bag 100 in drawstring bag configuration 100B inside out prior to use. In other embodiments, for example, where drawstring access opening(s) 55 are on outer layer 54, it may be preferable to refrain from turning convertible bag 100 in drawstring bag configuration 100B inside out prior to use. In some embodiments, convertible bag 100 in drawstring bag configuration 100B may retain full effectiveness regardless of whether or not it is turned inside out.

After step 390, method 300 may be completed. As would be understood by persons of ordinary skill in the art, one or more steps of method 300 may be omitted, altered, or rearranged while still accomplishing one or more purposes of this disclosure.

Although the foregoing embodiments have been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

It is noted that, as used herein and in any appended claims, the singular forms "a", "an", and "the" include plural referents unless the context clearly dictates otherwise. It is further noted that any claims may be drafted to exclude any optional element. As such, this statement is intended to serve as antecedent basis for use of such exclusive terminology as "solely," "only," and the like in connection with the recitation of claim elements, or use of a "negative" limitation. As will be apparent to those of ordinary skill in the art upon reading this disclosure, each of the individual aspects described and illustrated herein has discrete components and features which may be readily separated from or combined with the features of any of the other several aspects without departing from the scope or spirit of the disclosure. Any recited method can be carried out in the order of events recited or in any other order that is logically possible. Accordingly, the preceding merely provides illustrative examples. It will be appreciated that those of ordinary skill in the art will be able to devise various arrangements which, although not explicitly described or shown herein, embody the principles of the disclosure and are included within its spirit and scope.

In the present disclosure, the terms "first," "second," and the like are used for descriptive purposes only, and are not to be construed as indicating or implying a relative importance or a set number of technical features. Thus, features defining "first," "second," etc. may include one or more of the features, either explicitly or implicitly. In the description, unless otherwise stated, "a plurality of" means two or more. It should also be noted that terms "installation," "connected with each other," "connected," and the like are to be understood broadly, and may describe, for example, a fixed connection, a disassembled connection, an integral connection, a mechanical connection, an electrical connection, a direct connection, an indirect connection through an intermediate medium, and/or an internal connection between the inner portions of two elements. The specific meanings of the above and similar terms in the context of the present disclosure may be readily understood by a person of ordinary skill in the art.

Furthermore, all examples and conditional language recited herein are principally intended to aid the reader in understanding the principles of the invention and the concepts contributed by the inventors to furthering the art, and are to be construed without limitation to such specifically recited examples and conditions. Moreover, all statements herein reciting principles and aspects of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary configurations shown and described herein.

In this specification, various preferred embodiments have been described with reference to the accompanying drawings. It will be apparent, however, that various other modifications and changes may be made thereto and additional embodiments may be implemented without departing from the broader scope of any claims that follow. The specification and drawings are accordingly to be regarded in an illustrative rather than restrictive sense.

I claim:

1. A convertible bag, comprising:

a drawstring retention compartment;

a bag front, the bag front including a front perforation, a front part of the drawstring retention compartment, a mailer front top with a top flap;

a bag back, the bag back including a mailer back top, a back perforation, and a back part of the drawstring retention compartment;

a bag bottom;

a first side;

a second side; and at least one drawstring, the at least one drawstring disposed within the retention compartment, wherein:

the bag bottom, the first side, and the second side edge connect the bag front and the bag back;

the convertible bag is configured to be converted from a packaging mailer configuration to a drawstring bag configuration;

in the packaging mailer configuration, the top flap of the mailer front top is folded over and secured to the mailer back top to close the convertible bag;

the front perforation is disposed between the mailer front top and the front part of the drawstring retention compartment;

the back perforation is disposed between the mailer back top and the back part of the drawstring retention compartment;

the front perforation and the back perforation are configured to be simultaneously torn by hand; and in the drawstring bag configuration, the convertible bag is configured to be cinched closed by pulling a portion of the at least one drawstring out of the drawstring retention compartment.

2. The convertible bag of claim 1, wherein:

the at least one drawstring is not secured to any element of the convertible bag that is outside of the drawstring retention compartment.

3. The convertible bag of claim 1, further comprising a first drawstring access opening, wherein:

the first drawstring access opening is disposed along the front part of the drawstring retention compartment.

4. The convertible bag of claim 3, further comprising a second first drawstring access opening, wherein:

the second drawstring access opening is disposed along the back part of the drawstring retention compartment.

5. The convertible bag of claim 3, wherein:

the first drawstring access opening includes a gap in an outer layer of the front part of the drawstring retention compartment.

6. The convertible bag of claim 3, wherein:

the first drawstring access opening includes a gap on an inner layer of the front part of the drawstring retention compartment.

7. The convertible bag of claim 3, wherein:

in the packaging mailer configuration, the first drawstring access opening is covered by a first drawstring access panel; and the front part of the drawstring retention compartment includes the first drawstring access panel.

8. The convertible bag of claim 7, wherein:

the connection between the first drawstring access panel and at least one component of a remainder of the front part of the drawstring retention compartment is perforated.

9. The convertible bag of claim 1, further comprising:

a first drawstring anchor, wherein the first drawstring anchor is configured to prevent the at least one drawstring from rotating within the drawstring retention compartment.

10. The convertible bag of claim 9, wherein:

the first drawstring anchor comprises a seam along the first side.

11. The convertible bag of claim 10, further comprising:

a second drawstring anchor, wherein the second drawstring anchor comprises a seam along the second side.

12. The convertible bag of claim 1, further comprising:

a first drawstring access opening, wherein the first drawstring access opening is disposed along the drawstring retention compartment at the first side.

13. The convertible bag of claim 12, further comprising:

a second drawstring access opening, wherein the second drawstring access opening is disposed along the drawstring retention compartment at the second side.

14. The convertible bag of claim 1, wherein:

the front part of drawstring retention compartment is bounded by a front top seam and a front bottom seam; and the front top seam is at least partially co-extensive with the front perforation.

15. The convertible bag of claim 1, wherein:

the back part of drawstring retention compartment is bounded by a front back seam and a back bottom seam; and the back top seam is at least partially co-extensive with the back perforation.

16. The convertible bag of claim 1, wherein:

in the packaging mailer configuration, an entirety of the at least one drawstring is contained within the drawstring retention compartment.

17. A method of using a convertible bag, comprising:

receiving a convertible bag as a packaging mailer;

tearing a front perforation and a back perforation of the convertible bag to remove a top portion of the convertible bag;

removing first contents from the convertible bag;

placing second contents in the convertible bag;

pulling a portion of a drawstring of the convertible bag out of a drawstring retention compartment of the convertible bag;

cinching the convertible bag closed with the drawstring; and after removing first contents from the convertible bag, installing the convertible bag in a trash can, wherein: the step of placing second contents in the bag comprises placing refuse in the convertible bag.

18. The method of claim 17, further comprising:

after cinching the top of the convertible bag closed with the drawstring, making a knot with the drawstring to secure the refuse in the convertible bag.

19. The method of claim 17, further comprising:

before pulling the portion of the drawstring of the convertible bag out of the drawstring retention compartment of the convertible bag, removing a drawstring access cover.

* * * * *